United States Patent [19]

Scherrer et al.

[11] 4,133,169

[45] Jan. 9, 1979

[54] ELECTRONIC CIRCUIT FOR A QUARTZ CRYSTAL WATCH

[75] Inventors: Igor Scherrer, Colombier; Pierre Hersberger, Neuchatel, both of Switzerland

[73] Assignee: Ebauches S.A., Neuchatel, Switzerland

[21] Appl. No.: 788,754

[22] Filed: Apr. 19, 1977

Related U.S. Application Data

[63] Continuation of Ser. No. 600,869, Jul. 31, 1975, abandoned.

[30] Foreign Application Priority Data

Aug. 30, 1974 [CH] Switzerland ..... 11818/74

[51] Int. Cl.[2] ..... G04B 27/08; G04C 3/00

[52] U.S. Cl. ..... 58/23 R; 58/23 BA; 58/23 D; 58/85.5

[58] Field of Search ..... 58/23 R, 23 A, 23 BA, 58/23 AC, 33, 34, 50 R, 57, 85.5

[56] References Cited

U.S. PATENT DOCUMENTS

| | | | |
|---|---|---|---|
| 3,754,391 | 8/1973 | Fujita | 58/23 R |
| 3,792,577 | 2/1974 | Fujita | 58/23 R |
| 3,823,545 | 7/1974 | Vittoz et al. | 58/23 R |
| 3,842,585 | 10/1974 | Lupoli | 58/23 R |
| 3,852,951 | 12/1974 | Sauthier | 58/23 R |
| 3,895,486 | 7/1975 | Hammer et al. | 58/23 R |
| 3,901,022 | 8/1975 | Cleusix et al. | 58/85.5 |
| 3,916,612 | 11/1975 | Morokawa et al. | 58/23 R |
| 3,922,844 | 12/1975 | Sakamoto | 58/23 R |
| 3,937,003 | 2/1976 | Busch et al. | 58/23 D |
| 3,998,044 | 12/1976 | Yamauchi et al. | 58/23 R |
| 4,014,164 | 3/1977 | Fujita | 58/23 BA |
| 4,022,013 | 5/1977 | Kamijo | 58/23 R |
| 4,030,283 | 6/1977 | Sauthier et al. | 58/23 R |

OTHER PUBLICATIONS

R. G. Hibberd, Integrated Circuits, Texas Instruments Electronics Series, McGraw-Hill Book Company, pp. 1-11.

*Primary Examiner*—Stanley J. Witkowski
*Attorney, Agent, or Firm*—Imirie, Smiley & Guay

[57] ABSTRACT

An electronic timepiece havng an integrated electronic circuit including a quartz crystal oscillator, connected to a multi-stage divider, which divider supplies various outputs of various frequencies to corrector circuits, a logic circuit and a motor control circuit. The motor control circuit includes a switch to allow the timepiece to be stopped by resetting at least one stage of the divider. One of the terminals of the motor is connected to one of the stages of the divider to allow the control of the frequency of the signal issued from this stage, and, therefore, the frequency of the quartz oscillator.

4 Claims, 5 Drawing Figures

RRZ
RES
$f_1 \cdot f_2 \cdot f_3$
$\bar{f}_1$
$f_0$
$f_1$
$f_2$
$f_3$
$V_{BB}$
$-V_{BB}$
A
B
C
D
I1
I2
R1
R2
R3
R4
R5
R6
R9
T1
T2
T3
T4
T5
T6
T7
T8
T9
5
6
7
11
12
13
14
15
16
17
18
19
20
21

ELECTRONIC CIRCUIT FOR A QUARTZ CRYSTAL WATCH

This is a continuation, of application Ser. No. 600,869, filed July 31, 1975, and now abandoned.

BACKGROUND OF THE INVENTION

The present invention relates to an electronic circuit for a quartz crystal timepiece provided with a stepping motor and comprising an oscillator followed by a divider feeding a logic stage for the control of the said motor.

It is known that one of the principal problems in electronic timepieces consists in finding a way to reduce the size of the electronic circuits. Now in a circuit, particularly if it relates to an integrated circuit the terminal connections take up a lot of room. It is thus important to be able to reduce their number.

This number is defined on the one hand by those of the external components which must be connected to the circuit and on the other hand by those of the controlling and actuating terminals. It could concern for example the control of the frequency of the quartz crystal and the actuating of the stopping of the timepiece when it is to be reset.

In a quartz crystal timepiece having digital display using a stepping motor, the integrated circuit used comprises two supply terminals, two terminals for the quartz crystal, two terminals for the motor and one terminal for controlling stopping of the timepiece. There is no terminal for the measurement of the frequency of the quartz crystal, as this can be effected on one of the terminals of the motor. There is in effect, at this point, the frequency derived by division of that of the quartz crystal.

The terminal to which the motor is connected thus fulfils two functions, that of controlling a motor and that of permitting the measurement of the frequency of the quartz crystal.

SUMMARY OF THE INVENTION

The invention proposes to reduce the number of external terminals by a circuit in which the terminals used for the control of the motor also serve to test the frequency of the oscillator and/or to effect the stopping of the watch as well as the return-to-zero of the stages of the divider.

According to the present invention there is provided an electronic circuit for a quartz crystal timepiece provided with a stepping motor and comprising an oscillator followed by a divider feeding a logic stage for the control of the motor, external terminals of the circuit used for the control of the motor being utilised to regulate a frequency derived from the said divider and/or to effect the stopping of the timepiece when it is being returned-to-zero by at least one stage of the said divider.

The present invention will be described further, by way of example, with reference to the accompanying drawings.

DETAILED DESCRIPTION OF THE INVENTION

Figure 1:
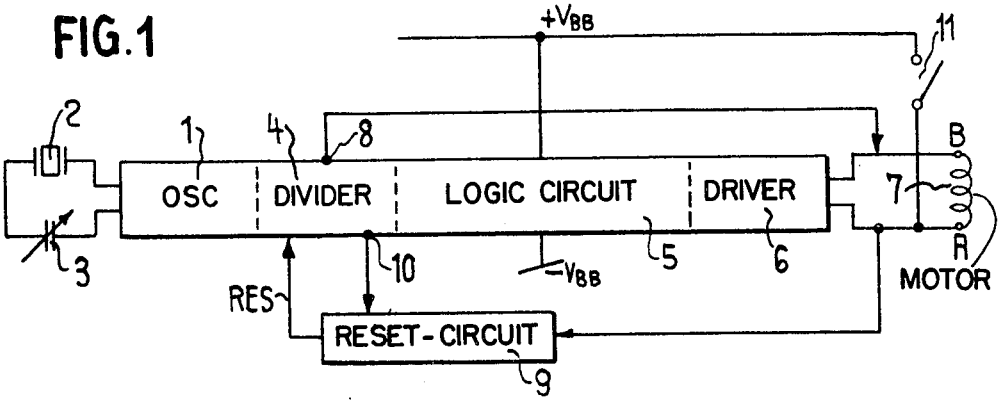
FIG. 1 is a schematic block diagram of a first circuit according to the present invention.

In FIG. 1 there is shown a circuit of a quartz crystal timepiece having a polarised stepping motor. An oscillator 1, provided with a quartz crystal 2 and a variable capacitor 3 for regulating the frequency, distributes its impulses on a divider 4 having several stages which actuates a logic circuit 5 for controlling the motor, shown schematically by a coil 7. Between the motor 7 and the control logic 5 there is a driver stage 6. Two supply terminals are shown at $+V_{BB}$ and $-V_{BB}$. To enable the frequency of the quartz crystal to be measured an output 8 of one of the stages of the divider 4 provides a frequency called "of measurement" to one of the terminals B of the motor 7. A measuring instrument may be applied to terminal B of motor 7 for measurement of the frequency transmitted form output 8 to terminal B, this measurement enabling determination of the frequency of oscillator 1. This measurement frequency is also supplied via the other terminal A of the motor 7 to a reset-circuit 9 which compares this frequency with another frequency called "reading signal" from an output 10 of one of the stages of the divider 4. A switch 11 to permit the watch to be stopped is connected between the terminal $+V_{BB}$ and the terminal A of the motor 7. The outlet of the comparator 9 can deliver a return-to-zero signal "RES" to all or some of the stages of the divider 4.

During normal functioning, when the switch 11 is open, the terminals A and B feed control current to the motor. The measurement frequency, applied at B, can likewise be measured at A between the drive impulses, as the resistance of the motor is small.

The comparator 9 permits the detection, by the rhythm of a reading signal, of the presence or absence of the measurement frequency at A between the drive impulses.

When the switch 11 is open the measurement frequency passes from B to A and the comparator 9 gives no return-to-zero signal "RES" at its outlet. On the other hand, the closing of the switch 11 pulls the terminal A to the potential $+V_{BB}$ of the battery, of which the low internal resistance blocks the transmission of the measurement frequency. The comparator 9 will then give a return-to-zero signal to the last or to all of the stages of the divider 4 to return them to zero and to lock them in this state.

After the time-setting of the timepiece by normal external mechanical means and the opening of the switch 11, the signal "RES" disappears and the divider 4 starts to function again. After a time interval determined by the number of stages which have been put back to zero, the motor will receive a drive impulse. The polarity of the impulse will always be the same, which implies a mechanical positioning of the motor at the time of the time-setting, so that it functions as soon as the first drive impulse is received.

Figure 2:
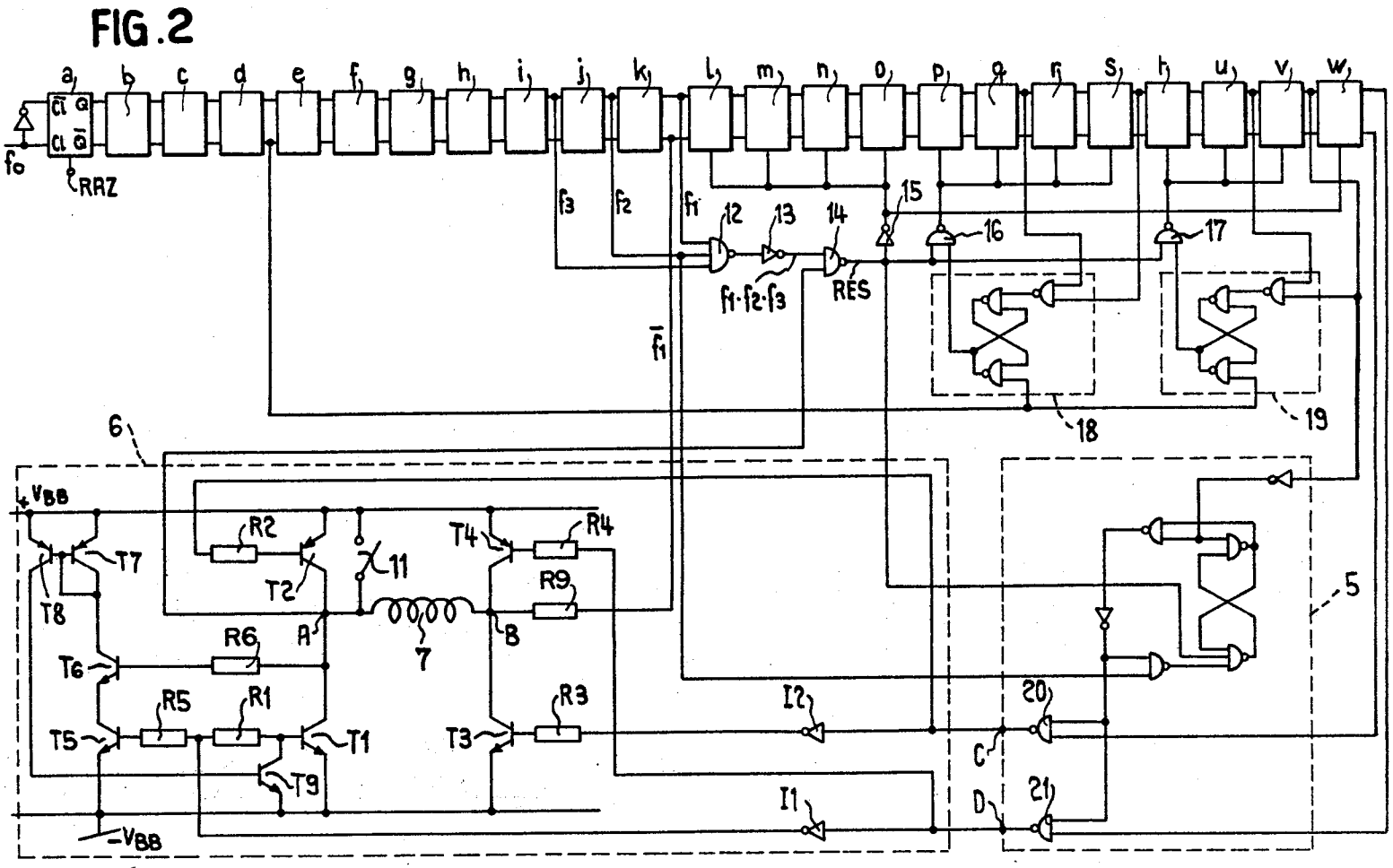
FIG. 2 is a detailed schematic diagram of the circuit of FIG. 1.

In the more detailed diagram of FIG. 2, there is illustrated a divider comprising the stages a to w, which are flip-flops having two inputs C1 and $\overline{C1}$ two outputs Q and $\overline{Q}$ and a zero resetting 'RAZ', and correctors 18 and 19 working across NAND gates 16 and 17. The frequency provided by the oscillator (not shown) is 32768 Hz and by a successive division by two, there is obtained at the outlet of the stage o a frequency of 1 Hz.

The stages p to s with the corrector 18 divide this frequency by ten then the stages t to v with the corrector 19, divide this result by six, so that the impulses at the outlet of the stage v will have a period of one minute. The correctors 18 and 19 work in known manner, and detect the potentials "1" at certain outlets of the divider stages to send a short impulse coming, in our example, from the outlet $\overline{Q}$ of the stage d, across the NAND gates 16 and 17 to the zero resetting inputs of the stages p to v. In the logic circuit 5 the outlets Q and $\overline{Q}$ of the final stage w alternately open the NAND gates 20 and 21 each minute. Once in a minute the outlet Q of the stage v enables an impulse provided by the outlet Q of the stage j ($f_2$) to reach the gates 20 and 21. This impulse will only pass the NAND gate 20 or 21 which has just opened at this instant to actuate the motor 7 in a manner which will be described hereunder.

The pilot stage 6 comprises two pairs of complimentary transistors $T_1$, $T_2$, and $T_3$, $T_4$, the emitters of $T_1$ and $T_3$ are connected to the terminal $-V_{BB}$ of the battery, the emitters of $T_2$ and $T_4$ are, themselves, connected to the terminal $+V_{BB}$, the collectors of $T_1$ and $T_2$ are connected and form the terminal A of the motor 7 whilst the collectors of $T_3$ and $T_4$, likewise connected, form the terminal B of the motor 7. The outlet C of the logic circuit 5 feeds the base of $T_2$ via a resistance $R_2$ and the base of $T_3$ via an inverter $I_2$ and a resistance $R_3$, whilst the outlet D of the logic circuit 5 feeds the base of $T_4$ via a resistance $R_4$ and the base of $T_1$ via an inverter $I_1$ and a resistance $R_1$. In the example shown the timepiece does not give any indication of the seconds, the motor 7 only receives one impulse per minute. This impulse is of short duration (for example between 15 and 20 milliseconds, in the example under consideration this duration is of 15,625 ms). In the example of FIG. 2, the outlets C and D are in a logic state "1" corresponding to the voltage $+V_{BB}$, the transistors $T_1$, $T_2$, $T_3$ and $T_4$ are blocked and no current at all can pass into the winding of the motor 7. A first drive impulse is released if, for example, the outlet C emits a negative impulse (logic level "0" corresponding to the voltage $-V_{BB}$). In effect, during this impulse, the transistor $T_3$ will open, shortcircuiting the terminal B to the terminal $-V_{BB}$, the transistor $T_2$ will likewise open and the terminal A will be short-circuited to the terminal $+V_{BB}$. The current impulse will thus pass from A to B. One minute later, it is the turn of the outlet D to provide a negative impulse which will open the transistors $T_1$ and $T_4$: the terminal B will then be found at the voltage $+V_{BB}$ and the terminal A at the voltage $-V_{BB}$. The current will thus pass from B to A. The polarity of the drive impulses is thus reversed from one impulse to the other.

In FIG. 2 several trains of impulses $f_1$, $f_2$, $f_3$, the frequencies of which differ are taken from the divider 4. These trains of impulses feed the inputs of a NAND gate 12. The output of this NAND gate 12 supplies a reading signal via an inverter 13 to one of the inputs of a second NAND gate 14. The complementary train of impulses of $f_1$, thus $\overline{f_1}$ is taken to the terminal B of the motor 7 through a resistor R9. This frequency can then be measured at the terminal A or B of the motor 7. The train of impulses $\overline{f_1}$ then feeds the second input of the NAND gate 14. A switch 11 is placed between the feed terminal $+V_{BB}$ and the terminal A of the motor 7.

Figure 3:
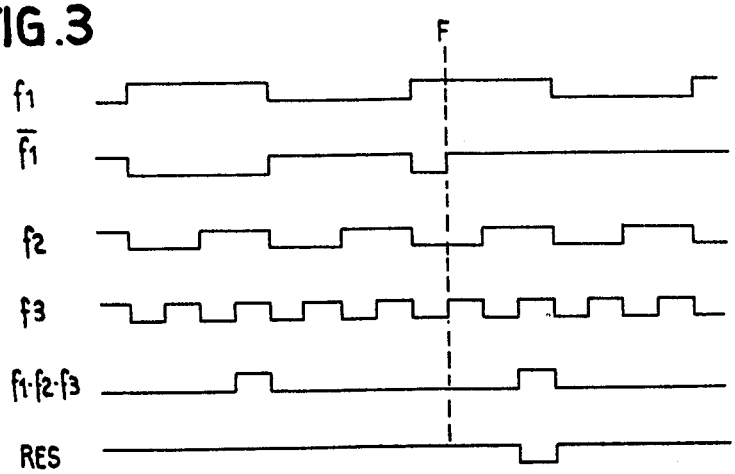
FIG. 3 is an impulse diagram of the circuit of FIG. 2.

The diagram of FIG. 3 illustrates the functioning of FIG. 2. In normal functioning (to the left of the broken line F) the reading signal resulting from the conjunction of the impulses $f_1$, $f_2$, and $f_3$ at the output of inverter 13 is shown which in Boolean algebra reads:

$$f_1 \cdot f_2 \cdot f_3,$$

This signal does not pass the NAND gate 14 which is receiving the complimentary impulses $\overline{f_1}$ at its second input. As soon as the switch 11 (broken line F) is closed, the impulses from the reading signal $f_1 \cdot f_2 \cdot f_3$ will pass the NAND gate 14 and furnish the impulse RES. These latter impulses RES, on the one hand via the inverter 15 will return the stages l, m, n, o and w, to zero, and on the other hand, via the NAND gates 16 and 17 will return the stages p to v to zero. These impulses RES permit moreover inhibition of the logic circuit 5 which will maintain its outlets C and D at potential "1" and no drive impulse will thereafter be supplied to the motor 7.

The diagram of FIG. 3 illustrates the functioning of the zero resetting. It can be seen that thanks to the inverter 13, the output of the NAND gate 14, during normal working, cannot deliver any return-to-zero signal RES. However, as soon as the switch 11 is closed, terminal A passes to the logic level "1" and the first impulse issued from the NAND gate 12 is transmitted to the stages of the divider 4. The broken line F indicates the instant at which the switch 11 closes. It is noted that the motor will restart one minute after the reopening of the switch 11.

It could happen that the switch 11 is closed during a drive impulse, that is to say when the terminal A is short circuited by the transistor $T_1$ to the terminal $-V_{BB}$. To avoid a short circuiting of the battery there can again be seen in FIG. 2 a protection device. This comprises the NPN transistor $T_5$ the base of which is connected by a resistance $R_5$ at the output of the inverter $I_1$, its emitter is connected on the terminal $-V_{BB}$ and its collector is connected to the emitter of an NPN transistor $T_6$ the base of which is connected, through a resistor R6 to the terminal A of the motor 7 and the collector of which goes to the collector of a PNP transistor $T_7$ connected as a diode and the emitter of which is connected to the terminal $+V_{BB}$. The base of the transistor $T_7$ is connected to the base of a PNP transistor $T_8$ the emitter of which is connected to the terminal $+V_{BB}$ and the collector of which is connected directly to the base of a NPN transistor $T_9$ the collector of which is connected directly to the base of the transistor $T_1$ and the emitter of which is connected to the terminal $-V_{BB}$.

When the transistor $T_1$ is saturated $T_5$ is also saturated and the point A is at $-V_{BB}$. If the switch 11 is closed, A passes very rapidly to $+V_{BB}$ and the battery discharges a large current. In this state, $T_6$ conducts and the current of its collector is transmitted by the transistors $T_7$ and $T_8$ to the transistor $T_9$ which becomes saturated and blocks $T_1$. Thanks to this device the short circuit current only lasts a very short instant, equal to the turn on time of the transistors $T_6$, $T_7$, $T_8$ and $T_9$.

Figure 4:
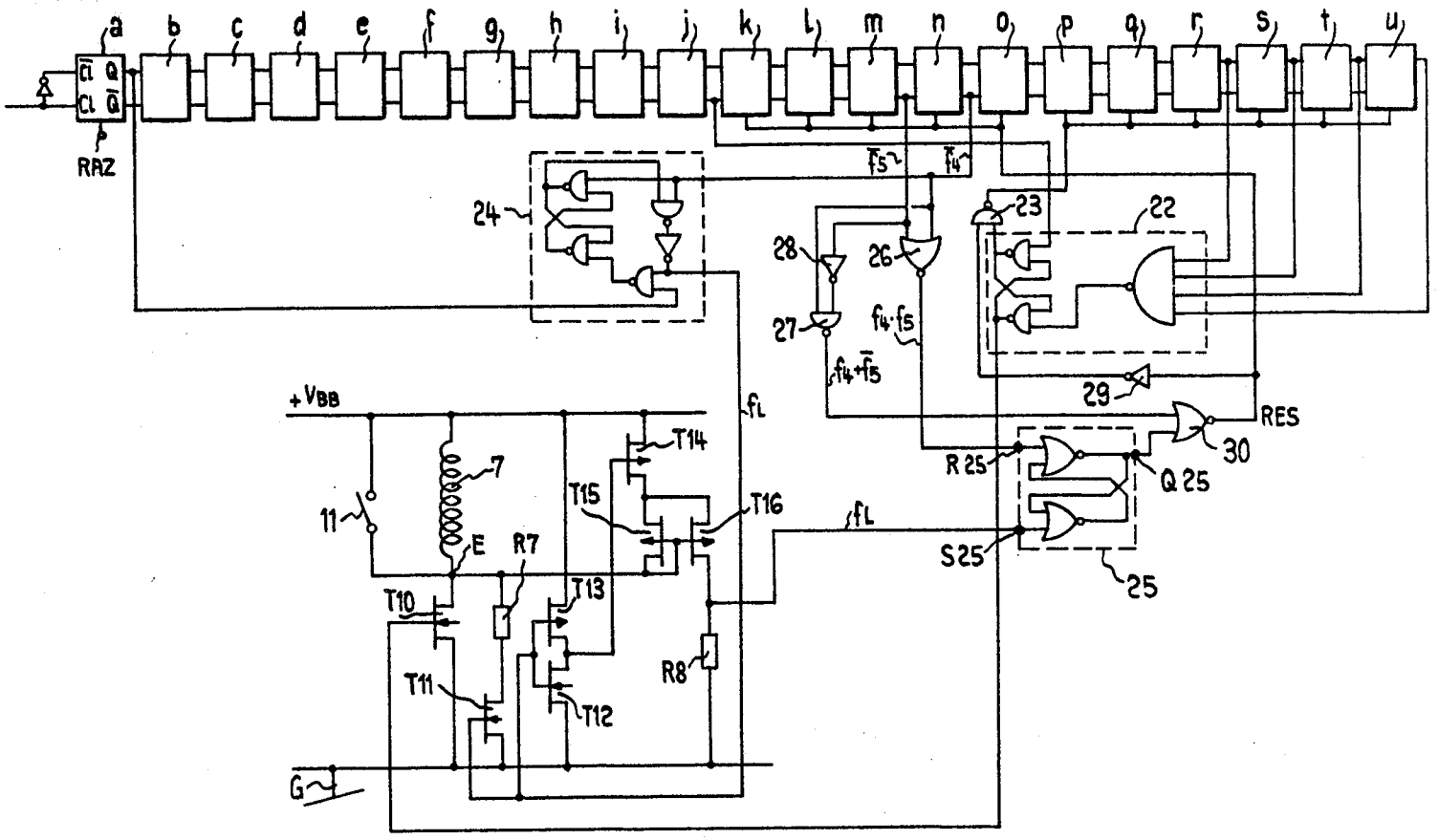
FIG. 4 is a detailed schematic diagram of a second embodiment.

FIG. 4 illustrates another example of an embodiment with a single pole motor. Note likewise that the pilot stage of the motor 7 is composed of MOSFET transistors. The dividing chain 4 which, here, only comprises twenty-one stages a to u with a corrector 22 which permits dividing the frequency of the impulses at the output of the stage o (1 Hz) by 60. The correction impulse emanating from the outlet $\overline{Q}$ of the stage j every minute will pass the NAND gate 23, the reverse impulse can be used to control the motor 7. This will appear on the grid of the n-channel transistor T10 the source of which is connected to earth G and the drain of which is connected to the terminal E of the motor 7. The other terminal of the motor 7 is connected to the supply terminal $+V_{BB}$. At each drive impulse, the transistor T10 will open and will allow current to pass into the motor 7. As in the preceding example, the switch 11 is arranged in parallel with the motor 7. The logic circuit 24 furnishes impulses $f_L$, the frequency of which corresponds to that of the impulses $f_4$ at the outlet $\overline{Q}$ of the stage n (2 Hz) and the length of which corresponds to that of the impulses provided at the outlet Q of the stage a. These positive impulses $f_L$ drive the gate of an n-channel transistor T11, the source of which is connected to earth G and the drain, of which is connected via a resistance R7 to the terminal E of the motor. The impulses $f_L$ will thus appear at the terminal E of the motor. However, since the value of the resistance R7 is made equal to the resistance of the coil of the motor 7, the height of the impulses $f_L$ at the terminal E of the motor will only be $\frac{1}{2}V_{BB}$. They are thus too small and too short to actuate the motor, but sufficient to be counted. The impulses $f_L$ also feed the invertor, formed by the n-channel transistor T12 and by the p-channel transistor T13, providing inverted $f_L$ pulses which drive the gate of a p-channel transistor T14, the source of which is connected to the feed terminal $V_{BB}$ and the drain of which is connected to the sources of two other p-channel transistors T15 and T16. The gates of the transistors T15 and T16, and the drain of the transistor T15 are connected to the terminal E of the motor 7 whilst the drain of the transistor T16 is connected via a resistance R8 to the earth G of the circuit.

There can be seen that, the switch 11 being open, the impulses $f_L$ will be transmitted to the drain of the transistor T16, thus will appear positive, on the resistance R8. When the switch 11 is closed, the transistors T15 and T16 are blocked and the voltage on the resistance R8 remains zero.

The drain of the transistor T16 is connected to the input S25 of an RS flip-flop 25, the output Q25 of which feeds one of the inputs of a NOR gate 30. On the other hand, two trains of impulses $\overline{f_4}$ and $\overline{f_5}$ drawn from the outputs $\overline{Q}$ of the stages n and m respectively, feed the two inputs of a NOR gate 26 the output of which feeds the input R25 of the RS flip-flop 25. The impulses $\overline{f_4}$ likewise feed directly one of the inputs of a NAND gate 27. The impulses $\overline{f_5}$ feed the second inlet of the NAND gate 27 via an inverter 28. The output of NAND gate 27 is connected to the second input of the NOR gate 30. The output of this gate 30 is, on the one hand, connected to the return-to-zero inputs RES of the stages k to o of the divider, and, on the other hand, via an inverter 29 to one of the inputs of the NAND gate 23 which the corrector circuit 22 is connected.

Figure 5:
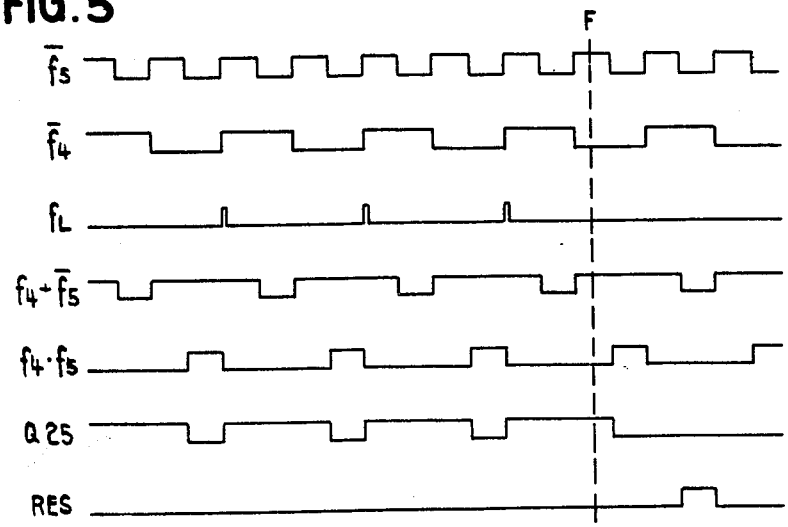
FIG. 5 is a set of impulse diagrams of the circuit of FIG. 4.

FIG. 5 illustrates the functioning of the return-to-zero impulses RES which appear at the output of the NOR gate 30 when the switch 11 is closed, the instant of its closing being indicated by the broken line F. From Boolean algebra, the output signal of the NAND gate 27 is written:

$$f_4 + \overline{f_5}$$

and the output signal of the NOR gate 26 is written:

$$f_4 \cdot f_5$$

Thus the signal $f_L$ is interrupted after the closing of the switch 11 which makes that the output Q25 of the flip-flop circuit 25 to remain at zero thus permitting the signal $f_4 + \overline{f_5}$ to pass the NOR gate 30.

It is obvious that the choice of impulse trains $f_4$ and $f_5$ is not fundamental, and other impulse train combinations may be used to form the reading signal and, parting, the return-to-zero signal.

What we claim is:

1. An electronic timepiece comprising a quartz crystal, a power supply having two output terminals, a stepping motor having two feeding terminals and an integrated circuit having terminals, said power supply terminals connected to said integrated circuit, said integrated circuit comprising:

an oscillator circuit coupled to said crystal for delivering on its output a first signal of a first frequency:

a multistage divider connected to said oscillator output for delivering on at least a first output a second signal of a second frequency;

a control stage connected to the first output of the divider for applying driving current pulses to the feeding terminals of the motor through a first and second of said integrated circuit terminals; and circuit means for performing at least one auxiliary function, directly connected to said first integrated circuit terminal, whereby no supplementary terminal is needed on said integrated circuit for connecting said circuit means.

2. The electronic timepiece of claim 1, wherein:

said divider is adapted to deliver, on a second output, a third signal of a third frequency; and said circuit means is further connected to the second output of said divider, to allow said first frequency to be checked by measuring the frequency of said third signal on the feeding terminal connected to said second integrated circuit terminal.

3. The electronic timepiece of claim 1, further comprising a switch connected between one of said power supply terminals and the feeding terminal connected to said first integrated circuit terminal, and wherein:

said circuit means further includes a reset circuit adapted to deliver a reset signal when said switch is closed;

said multistage divider has a reset input for resetting at least one of its stages; and said circuit means is further connected to said reset input.

4. The electronic timepiece of claim 3, wherein:

said divider is adapted to deliver, on a second output, a third signal of a third frequency; and said circuit means is further connected both to the second output of said divider and the second integrated circuit terminal, to allow said first frequency to be checked by measuring the frequency of said third signal on the feeding terminal connected to said second integrated circuit terminal.

* * * * *